US005971385A

United States Patent [19]

Belec

[11] Patent Number: 5,971,385

[45] Date of Patent: Oct. 26, 1999

[54] ENVELOPE FEEDER AND INTEGRAL FLAP OPENING DEVICE

[75] Inventor: Eric A. Belec, Southbury, Conn.

[73] Assignee: Pitney Bowes Inc., Stamford, Conn.

[21] Appl. No.: 08/876,418

[22] Filed: Jun. 16, 1997

[51] Int. Cl.[6] ..... B65H 5/00

[52] U.S. Cl. ..... 271/2; 271/35; 271/106; 53/381.7

[58] Field of Search ..... 271/2, 105, 106, 271/18, 94, 100, 35, 99; 53/381.5, 381.6, 381.7; 270/58.06

[56] References Cited

U.S. PATENT DOCUMENTS

| | | | |
|---|---|---|---|
| 1,724,199 | 8/1929 | Hoag | 271/2 |
| 3,051,286 | 8/1962 | Stange et al. | 221/6 |
| 3,973,767 | 8/1976 | Kramer | 271/100 |
| 4,106,762 | 8/1978 | Faltin | 271/99 |
| 4,318,265 | 3/1982 | Orsinger et al. | 53/492 |
| 4,328,962 | 5/1982 | Akers | 271/12 |
| 4,542,895 | 9/1985 | Blumle | 271/101 |
| 5,249,705 | 10/1993 | Gates | 221/6 |
| 5,450,187 | 9/1995 | Pei et al. | 271/2 |

*Primary Examiner*—H. Grant Skaggs
*Attorney, Agent, or Firm*—Ronald Reichman; Melvin J. Scolnick

[57] ABSTRACT

A device that opens the flap of an envelope before the envelope is separated from the envelope supply/stack hopper. A vacuum/suction device is used to pull the envelope flap below a stripping surface before the envelope is fed out of the supply/stack hopper. Thus, the envelope flap will be completely opened as each envelope is individually separated and fed out of the hopper.

15 Claims, 3 Drawing Sheets

ENVELOPE FEEDER AND INTEGRAL FLAP OPENING DEVICE

FIELD OF THE INVENTION

The invention relates generally to the field of preparing mail pieces and more particularly to inserting a mail piece in an envelope.

BACKGROUND OF THE INVENTION

In mail production equipment, various activities take place for the purpose of producing mail pieces. Such activities include the selection of inserts, the collection and stacking of the selected inserts, the placing of the inserts into an envelope and the sealing of the envelope to form the mail piece. In order for the inserts to be stuffed into an envelope, the mouth of the envelope may be opened so as to be able to receive the inserts.

Typically, the flap of the envelope is opened after the envelope has been removed from an envelope supply stack.

The prior art used a variety of different stripping blades to open the envelope while the envelope was in motion. The foregoing proved difficult to accomplish because the envelope was typically moving at a high rate of speed while the stripping blade attempted to engage the underside of the envelope flap to separate the flap from the envelope body. Consequently, the stripping blade did not always engage the underside of the envelope flap, resulting in unflapped or closed envelopes. A closed envelope will cause jamming during the insertion process.

SUMMARY OF THE INVENTION

This invention overcomes the disadvantages of the prior art by providing a device that opens the flap of an envelope before the envelope is separated from the envelope supply/stack hopper. A vacuum/suction device is used to pull the envelope flap below a stripping surface before the envelope is fed out of the supply/stack hopper. Thus, the envelope flap will be completely opened as each envelope is individually separated and fed out of the hopper.

The apparatus of this invention reduces jamming. An additional advantage of this invention is that the footprint associated with the envelope processing system is reduced because the finger and claw assemblies were eliminated.

Another advantage of this invention is that a simpler mechanism than that utilized by the prior art is used to open the flap of an envelope.

DETAILED DESCRIPTION OF THE PREFERRED EMBODIMENT

Figure 1:
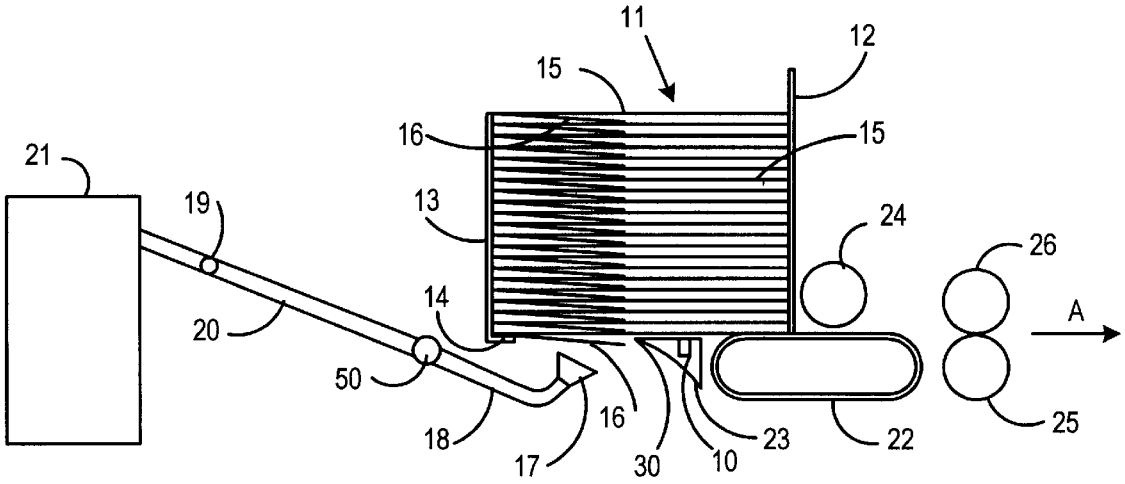
FIG. 1 is a drawing of a vertical stack of envelopes being fed by their long edge.

Referring now to the drawings in detail, and more particularly to FIG. 1 the reference character 11 represents a supply hopper having a registration wall 12 and a back guide 13. Back guide 13 has a lip 14 which supports one end of a plurality of envelopes 15 that are placed in hopper 11. Envelopes 15 have a flap 16. A suction cup 17 is positioned under flap 16 of bottom envelope 15 in hopper 11. Suction cup 17 is positioned on one end of tube 18. The other end of tube 18 is connected to one end of valve 19. The other end of valve 19 is connected to one end of tube 20. The other end of tube 20 is connected to vacuum source 21. Vacuum source 21 provides a negative pressure and air flow sufficient to completely seal suction cup 17 again envelope flap 16. The envelope 15 that is on the bottom of hopper 11 will rest on feed element 22. A sensor 10 is positioned in hopper 11 to detect the presence of the last envelope in hopper 11. Element 22 may be a roller, belt or other device known in the art for moving envelopes. A flap stripping member 23 is positioned to engage the lead edge of flaps 16 of envelopes 15 after suction cup 17 opens flap 16 of envelope 15 and element 22 moves envelope flap 16 in envelope transport direction A to member 23. Valve 19 will be closed and vacuum source 21 will be disconnected after envelope 15 is beyond tip 30 of member 23. Pivot 50 is connected to tube 18 and tube 20 and allows rotating motion of tube 18 about pivot 50.

A separation element 24 separates envelopes 15 from the other envelopes 15 in hopper 11. Element 22 will continue to move envelopes 15 in direction A so that envelopes 15 will be transported between spring loaded nip roller 25 and roller 26. Rollers 25 will continue to move envelopes 15 in direction A towards an insertion station (not shown). As is well known in the art inserts will be inserted in envelopes 15 at the insertion station.

Figure 2A:
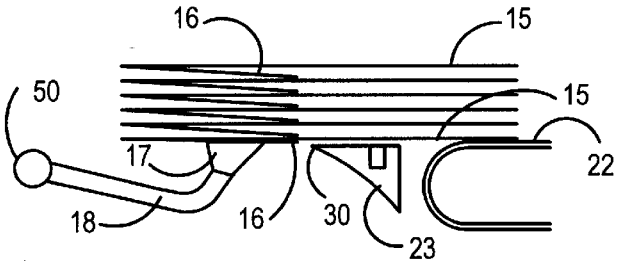
FIGS. 2A–2E are drawings showing the various steps that are performed in the opening of the flaps of envelopes 15 of FIG. 1.

FIGS. 2A–2E are drawings showing the various steps that are performed in the opening of flaps 16 of envelopes 15 of FIG. 1. In FIG. 2A suction cup 17 is shown being indexed upward around pivot 50 so that it will be positioned in contact with flap 16 of the bottom envelope 15. At this juncture valve 19 will be turned on and the vacuum in tube 18 and suction cup 17 will cause suction cup 17 to acquire flap 16 of bottom envelope 15.

Figure 2B:
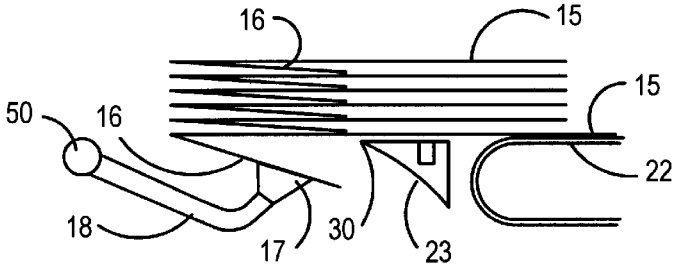

In FIG. 2B suction cup 17 is shown being indexed slightly downward around pivot 50 while the vacuum in tube 18 and suction cup 17 is causing flap 16 of bottom envelope 15 to move away from the body of bottom envelope 15.

Figure 2C:
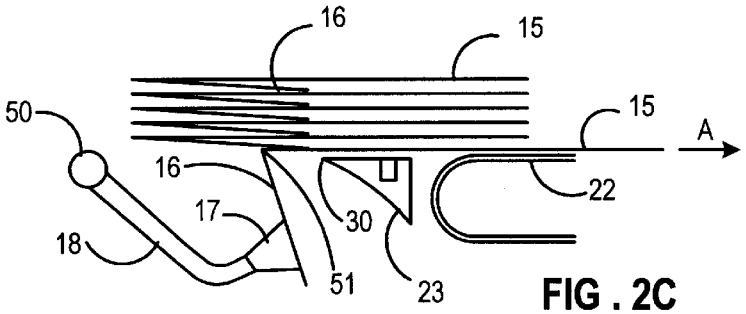

In FIG. 2C bottom envelope 15 has been moved slightly in direction A by feed element 22. At this point valve 19 will be turned off and the vacuum in tube 18 and suction cup 17 will be removed. The distance between tip 30 of stripping member 23 and the crease line 51 of envelope 15 must be shorter than the length of flap 16 when vacuum source 21 is turned off by valve 19. Tip 30 of stripping member 23 will begin to engage flap 16 of bottom envelope 15 so that member 30 will maintain the separation of flap 16 of bottom envelope 15 from its body.

Figure 2D:
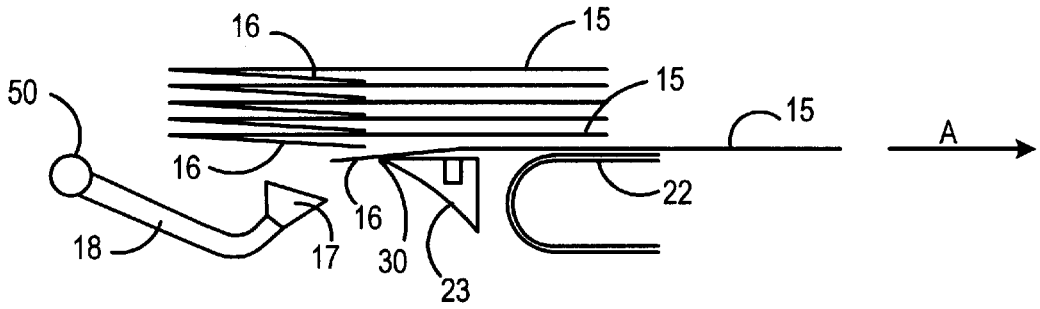

In FIG. 2D bottom envelope 15 has been moved further in direction A by feed element 22. At this point tip 30 of member 23 will move flap 16 of bottom envelope 15 further from the body of envelope 15.

Figure 2E:
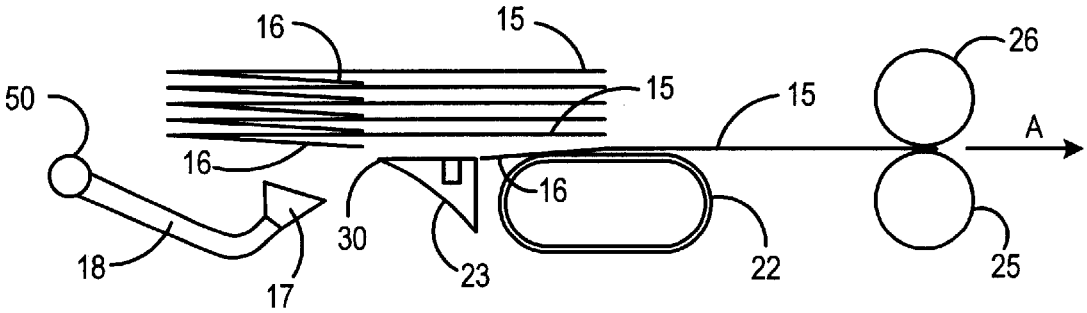

In FIG. 2E bottom envelope 15 has been moved still further in direction A by feed element 22. At this point tip 30 of member 23 will be to the left of flap 16 of bottom envelope 15 and part of bottom envelope 15 will be between rollers 25 and 26. Rollers 25 and 26 will move bottom envelope 15, with flap 16 open towards an insertion station. Valve 19 and suction cup 17 will be indexed upward around pivot 50 so that suction cup 17 will be positioned in contact with flap 16 of the next bottom envelope 15. The above process will continue until there are no more envelopes 15 in hopper 11.

Figure 3:
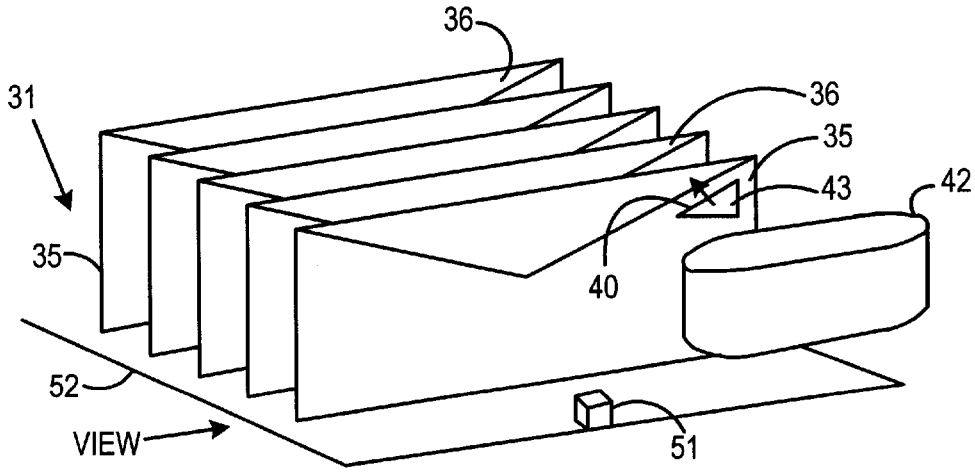
FIG. 3 is a drawing of an alternate embodiment of this invention showing a stack of vertically oriented envelopes being fed by their short edge.

FIG. 3 is a drawing of an alternate embodiment of this invention showing a stack of vertically oriented envelopes being fed by their short edge. It will be obvious to one skilled in the art that the envelopes may be oriented at many different angles. Supply hopper 31 has a bottom deck 52, which supports the bottom edges of a plurality of envelopes 35 that are placed in hopper 31. Envelopes 35 have a flap 36. The envelope 35 that is at the front of hopper 31 will rest on feed element 42. Element 42 may be a roller, belt or other device known in the art for moving envelopes. A flap stripping member 43 is positioned to engage flaps 36 of envelopes 35 after suction cup 17 (shown in FIG. 4) opens flap 36 of envelope 35. A sensor 51 is present in hopper 31 to detect the presence of the last envelope in hopper 31.

Figure 4:
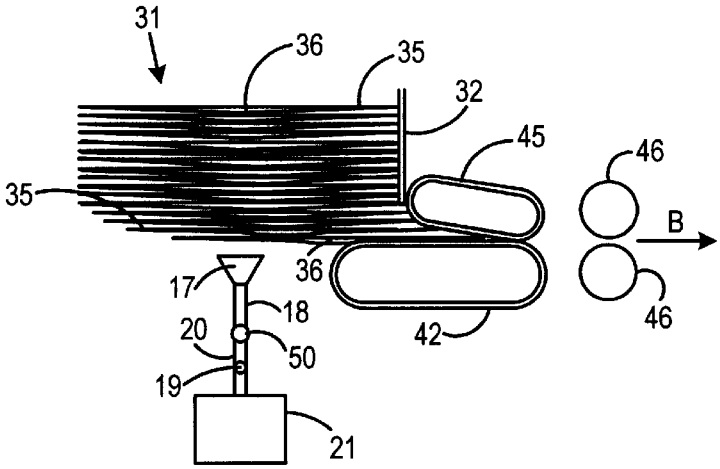
FIG. 4 is a drawing of another view of a horizontal stack of envelopes being fed by their short edge.

FIG. 4 is a drawing of another view of a horizontal stack of envelopes being fed by their short edge. A suction cup 17 is positioned adjacent to flap 16 of bottom envelope 15 in hopper 1 1. Suction cup 17 is positioned on one end of tube 18. The other end of tube 18 is connected to one end of valve 19. The other end of valve 19 is connected to one end of tube 20. The other end of tube 20 is connected to vacuum source 21. Vacuum source 21 provides a negative pressure and air flow sufficient to seal suction cup 17 against envelope flap 16. The envelope 35 that is resting on feed element 42 will be moved in direction B. A separation element 45 is positioned to the right of registration wall 32. Rollers 45 and 46 will continue to move envelopes 35 in direction B towards an insertion station (not shown). As is well known in the art inserts will be inserted in envelopes 35 at the insertion station.

Figure 5A:
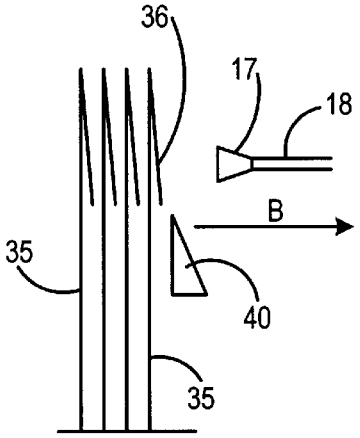
FIGS. 5A–5C are drawings showing various steps in the opening of the envelopes of FIG. 3 and FIG. 4.

FIGS. 5A–5E are drawings showing various steps in the opening of flaps 36 of envelopes 35 of FIG. 3 and FIG. 4. In FIG. 5A suction cup 17 is shown away from flap 36 of the front envelope 35. At this juncture valve 19 will be turned off.

Figure 5B:
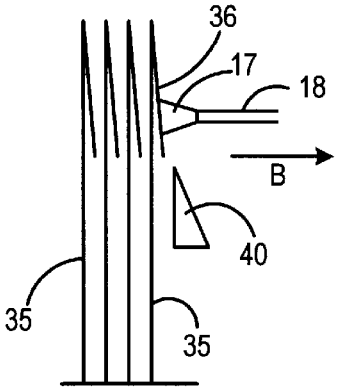

In FIG. 5B suction cup 17 is shown being indexed upward so that it will be positioned in contact with flap 36 of front envelope 35. This indexing motion may be provided by utilizing a mechanical linkage actuated by a cam solenoid, etc. (not shown). At this juncture valve 19 will be turned on and the vacuum in tube 18 and suction cup 17 will cause suction cup 17 to acquire flap 36 of front envelope 35.

Figure 5C:
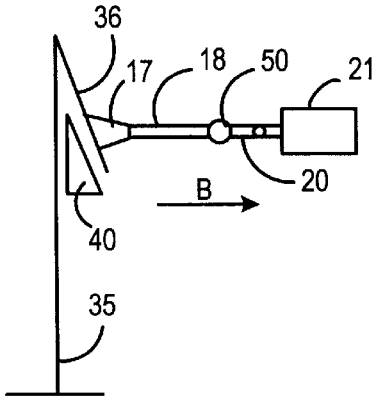

In FIG. 5C suction cup 17 is shown opening flap 36 of front envelope 35, while the vacuum in tube 18 and suction cup 17 is causing flap 36 of front envelope 35 to move away from the body of bottom envelope 15. Stripping member 40 is engaging flap 36. Member 40 may be moved by a mechanical linkage actuated by a cam, solenoid, etc. (not shown). It would be obvious to one skilled in the art that optimal placement of the stripping member 40 may eliminate the requirement for stripping member 40 to move dynamically.

The above specification describes a new and improved envelope feeder and flap opening device. It is realized that the above description may indicate to those skilled in the art additional ways in which the principles of this invention may be used without departing from the spirit. It is, therefore, intended that this invention be limited only by the scope of the appended claims.

What is claimed is:

1. A device for opening the flap of the bottom envelope in a stack of envelopes wherein the improvement comprises:

a vacuum device positioned adjacent to the flap of the bottom envelope which allows the opening of the flap of the bottom envelope with a vacuum force produced by a vacuum device while the bottom envelope is in the stack before the envelope is transported to the point at which an insert is placed within the envelope;

means for moving the bottom envelope away from the stack; and means for engaging the flap of the bottom envelope to further open the flap of the bottom envelope as the moving-means moves the bottom envelope away from the stack.

2. The device claimed in claim 1, further including:

means for determining the last envelope in the stack.

3. The device claimed in claim 2, wherein the bottom envelope is being moved in the direction of the long edge of the bottom envelope.

4. The device claimed in claim 1, wherein the vacuum device further includes:

a vacuum source;

a tube having one end coupled to the vacuum device, wherein the other end of the tube opens the flap of the bottom envelope when the vacuum device is turned on.

5. The device claimed in claim 4, further including:

a suction cup that is connected to the other end of the tube so that the suction cup opens the flap of the bottom envelope when the vacuum device is turned on.

6. The device claimed in claim 1, wherein the vacuum device comprises:

a vacuum source;

a first tube having one end coupled to the vacuum source;

a valve that is connected to the other end of the first tube;

a second tube having one end connected to the valve; and a suction cup that is connected to the other end of the second tube, wherein the suction cup opens the flap of the bottom envelope when the valve is opened.

7. The device claimed in claim 6, further including:

a pivot that enables the suction cup to be oriented in different directions.

8. A device for opening the flap of the first envelope in a vertically disposes stack of envelopes wherein the improvement comprises:

opening the flap of the first envelope, with a vacuum force produced by a vacuum device while the first envelope is in the stack before the envelope is transported to the point at which an insert is placed within the envelope;

means for moving the first envelope away from the stack; and means for engaging the flap of the first envelope to further open the flap of the first envelope as the moving means moves the first envelope away from the stack.

9. The device claimed in claim 8, further including:

means for stripping the first envelope away from the stack as the first envelope moves away from the stack.

10. The device claimed in claim 9, further including:

means for determining the last envelope in the stack.

11. The device claimed in claim 8, wherein the first envelope is being moved in the direction of the short edge of the first envelope.

12. The device claimed in claim 8, wherein the vacuum device comprises:

a vacuum source;

a tube having one end coupled to the vacuum source, wherein the other end of the tube opens the flap of the first envelope when the vacuum source is activated.

13. The device claimed in claim 12, further including:

a suction cup that is connected to the other end of the tube so that the suction cup opens the flap of the first envelope when the vacuum source is activated.

14. The device claimed in claim 8, wherein the vacuum device comprises:

a vacuum source;

a first tube having one end coupled to the vacuum source;

a valve that is connected to the other end of the first tube;

a second tube having one end connected to the valve; and a suction cup that is connected to the other end of the second tube, wherein the suction cup opens the flap of the bottom envelope when the valve is opened.

15. The device claimed in claim 14, further including:

a pivot rotates so that enables the suction cup to be oriented in different directions.

* * * * *